US007955072B2

(12) United States Patent
Ojiro et al.

(10) Patent No.: US 7,955,072 B2
(45) Date of Patent: Jun. 7, 2011

(54) FORCED AIR SUPPLY COMBUSTION APPARATUS

(75) Inventors: Takashi Ojiro, Nagoya (JP); Yoshihiko Takasu, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 832 days.

(21) Appl. No.: 11/951,806

(22) Filed: Dec. 6, 2007

(65) Prior Publication Data

US 2008/0145806 A1 Jun. 19, 2008

(30) Foreign Application Priority Data

Dec. 14, 2006 (JP) ..... 2006-337194

(51) Int. Cl.
*F23C 5/08* (2006.01)

(52) U.S. Cl. ..... 431/181; 431/12; 431/328; 126/92 R; 126/92 AC

(58) Field of Classification Search ..... 431/181, 431/12, 285, 278, 328, 326; 126/292 R, 126/92 AC, 92 C
See application file for complete search history.

(56) References Cited

U.S. PATENT DOCUMENTS 6,916,175 B2 * 7/2005 Cho et al. ..... 431/354

FOREIGN PATENT DOCUMENTS

| | | |
|---|---|---|
| DE | 31 13 270 | 10/1982 |
| JP | H03-071247 | 7/1991 |
| JP | 07-318048 | 12/1995 |
| WO | 2006-019279 | 2/2006 |

* cited by examiner

*Primary Examiner* — Alfred Basichas
(74) *Attorney, Agent, or Firm* — Rankin, Hill & Clark LLP

(57) ABSTRACT

A combustion apparatus with an air supply chamber in a lower part partitioned by a partition plate from an arrangement section of a burner unit and a primary air chamber in a front part stands from a front end of the air supply chamber are provided in a combustion housing incorporating the burner unit. Air from a combustion fan connected to an air supply port of the air supply chamber flows to the primary air chamber through the air supply chamber. Primary air is supplied from the primary air chamber to burners of the burner unit. Projected rims extend from the periphery of a portion of the partition plate opposed to the air supply port to a front edge of the partition plate are provided on a lower surface of the partition plate. The height of a downward projection of the projected rims is reduced toward the air supply port.

12 Claims, 5 Drawing Sheets

FORCED AIR SUPPLY COMBUSTION APPARATUS

BACKGROUND OF THE INVENTION

1. Field of the Invention

The present invention relates to a forced air supply combustion apparatus that supplies primary air with a combustion fan.

2. Description of the Related Art

Conventionally, as a combustion apparatus of this type, there is known a combustion apparatus in which, in a combustion housing, a burner unit including a plurality of burners provided side by side in the horizontal direction is arranged and an air supply chamber in a lower part partitioned by a partition plate from an arrangement section of the burner unit and a primary air chamber in a front part that stands from a front end of the air supply chamber are provided, the air from a combustion fan, which is connected to an air supply port opened on a bottom surface of the air supply chamber, flows to the primary air chamber through the air supply chamber, and the primary air is supplied from the primary air chamber to the respective burners of the burner unit (see, for example, Japanese Patent Laid-Open No. 7-318048).

In order to prevent the combustion fan from interfering with the other members, it may be inevitable to open the air supply port in a position biased to one side in the horizontal direction on the bottom surface of the air supply chamber. The air from the combustion fan naturally flows in the air supply chamber. Therefore, when the air supply port is opened in the position biased to one side in the horizontal direction, a pressure distribution in the primary air chamber becomes nonuniform and a supply quantity of the primary air to a part of the burners becomes excessively larger or excessively small.

SUMMARY OF THE INVENTION

The present invention has been devised in view of the circumstances and it is an object of the present invention to provide a forced air supply combustion apparatus that can uniformalize the pressure distribution in the primary air chamber and supply the primary air to all the burners equally.

In order to attain the object, the present invention provides a forced air supply combustion apparatus in which, in a combustion housing, a burner unit including a plurality of burners provided side by side in the horizontal direction is arranged and an air supply chamber in a lower part partitioned by a partition plate from an arrangement section of the burner unit and a primary air chamber in a front part that stands from a front end of the air supply chamber are provided. The air from a combustion fan connected to an air supply port opened on a bottom surface of the air supply chamber flows to the primary air chamber through the air supply chamber, and the primary air is supplied from the primary air chamber to the respective burners of the burner unit. A plurality of projected rims projected downward are provided on a lower surface of the partition plate to connect a plurality of upstream side section points set around a portion of the partition plate, which is opposed to the air supply port, with a space formed between the section points in a peripheral direction of the portion of the partition plate and a plurality of downstream side section points set at a front edge of the partition plate with a space formed between the section points in the horizontal direction of the partition plate.

According to the present invention, the air from the combustion fan, which flows in from the air supply port, is distributed and flows to a plurality of areas of the air supply chamber sectioned by the plurality of projected rims. Even if the air supply port is opened in a position biased to one side in the horizontal direction, by arranging the respective projected rims to set a quantity of distribution to the respective areas to a predetermined quantity necessary for uniformalizing a pressure distribution in the primary air chamber, it is possible to uniformalize the pressure distribution in the primary air chamber and supply the primary air to all the burners equally.

When a position and an angle of connection of the combustion fan to the air supply port fluctuate, it is likely that the quantity of distribution of the air to the plurality of areas of the air supply chamber also fluctuates and the pressure distribution in the primary air chamber becomes nonuniform.

Therefore, in the present invention, it is desirable that the portion of the partition plate opposed to the air supply port is formed in a concave shape recessed upward. Consequently, the air from the combustion fan, which flows in from the air supply port, is once collected in the concave shape portion of the partition plate opposed to the air supply port, a static pressure area having a uniform pressure distribution is generated, and the air is distributed from the static pressure area to the plurality of areas of the air supply chamber sectioned by the plurality of projected rims. Even if the position and angle of connection of the combustion fan to the air supply port fluctuate, since the air from the combustion fan is collected in the concave shape portion of the partition plate, the fluctuation in the position and the angle of connection of the combustion fan is absorbed. Therefore, it is possible to effectively prevent a fluctuation from occurring in the quantity of distribution of the air to the plurality of areas of the air supply chamber because of the fluctuation in the position and the angle of connection of the combustion fan.

In the present invention, it is desirable that the height of a downward projection of the respective projected rims decreases toward the respective upstream side section points. Consequently, the plurality of areas of the air supply chamber sectioned by the plurality of projected rims communicate with one another in a wide area in an upstream portion close to the air supply port. Therefore, a pressure in the upstream portion of the plurality of areas is equalized by the mutual communication. It is possible to prevent a fluctuation from occurring in the quantity of distribution of the air to the plurality of areas of the air supply chamber because of the fluctuation in the position and the angle of connection of the combustion fan to the air supply port.

In this case, it is desirable that the height of the downward projection of the respective projected rims at the respective downstream side section points is set to 70% to 100% of a height dimension of the air supply chamber and the height of the downward projection of the respective projected rims at the respective upstream side section points is set to 0% to 30% of the height dimension of the air supply chamber.

In the present invention, it is desirable that a portion closer to the respective downstream side section points of the respective projected rims connecting the respective upstream side section points and the respective downstream side section points, which are offset in the horizontal direction with respect to the respective upstream side section points, extends in a front to back direction over a predetermined length. Consequently, a rectifying flow for directing an air flow to the front is obtained. It is possible to prevent the air having a motion component in the horizontal direction from flowing into the primary air chamber.

DETAILED DESCRIPTION OF THE PREFERRED EMBODIMENTS

Figure 1:
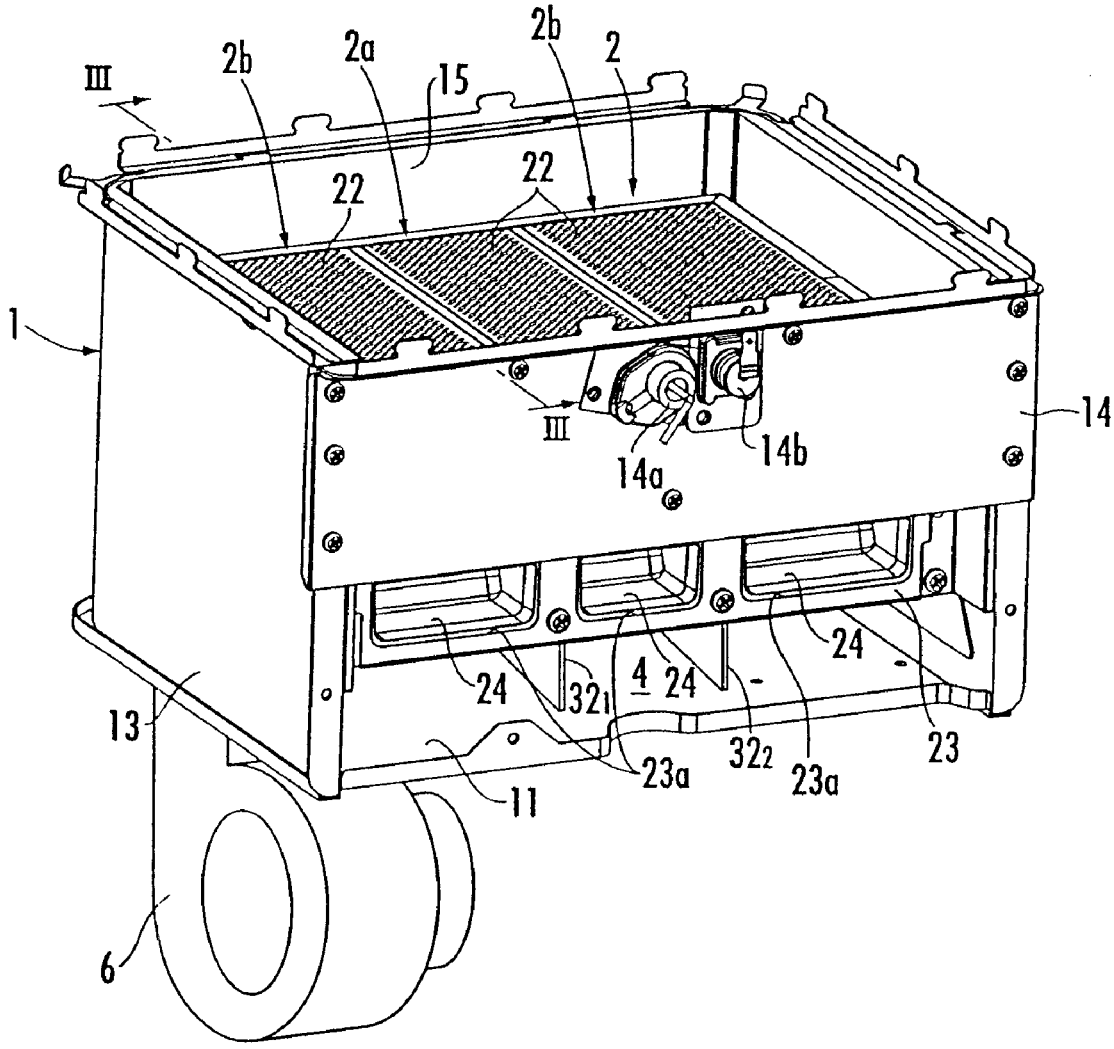
FIG. 1 is a perspective view showing a combustion apparatus according to an embodiment of the present invention.
Figure 2:
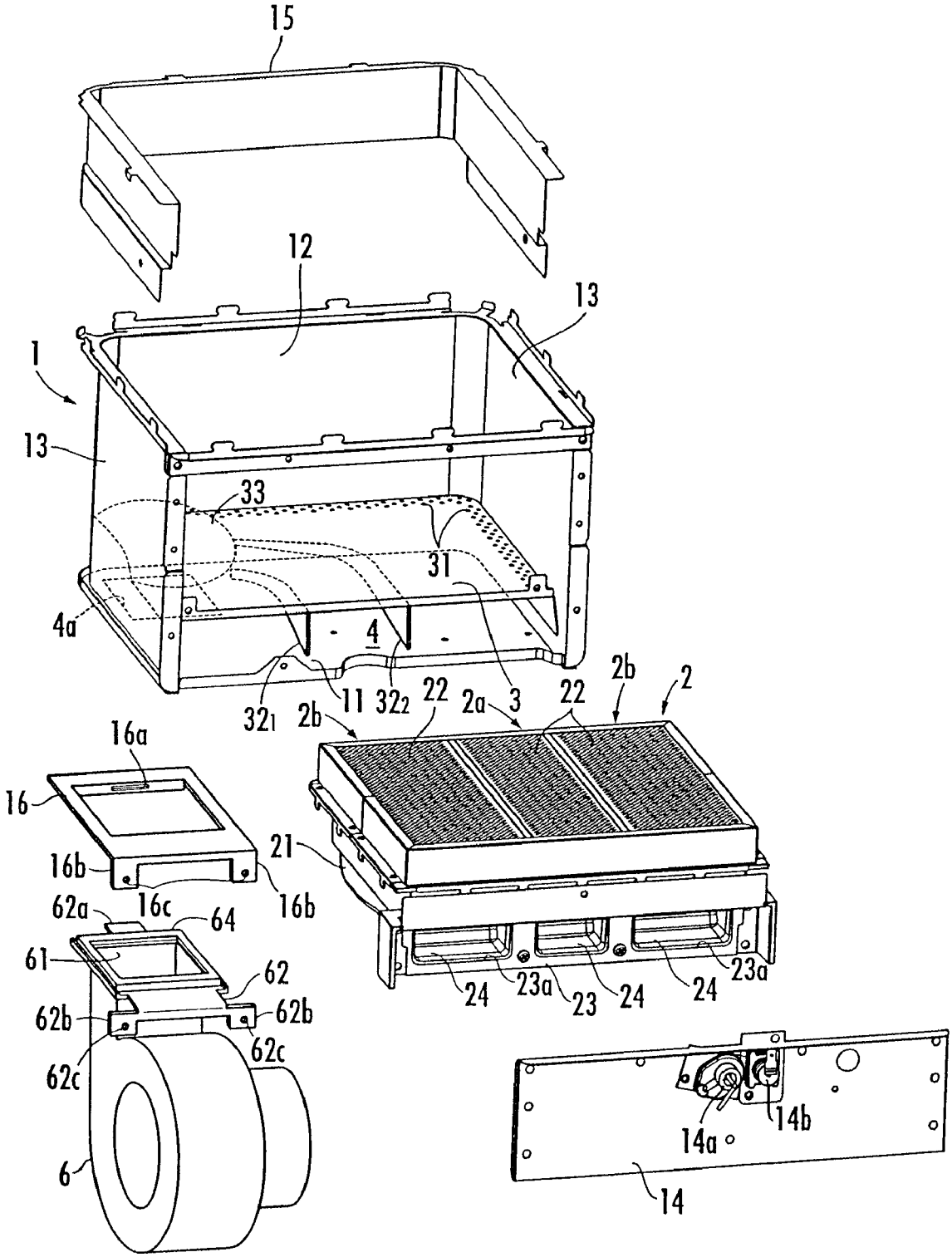
FIG. 2 is a perspective view of a disassembled state of the combustion apparatus according to the embodiment.

Referring to FIGS. 1 and 2, reference numeral 1 denotes a combustion housing in which an object to be heated (not shown) such as a heat exchanger for hot water supply is arranged in an upper part thereof. A burner unit 2 is arranged in the combustion housing 1.

The combustion housing 1 includes a bottom plate 11, and also includes a rear plate 12 and left and right side plates 13, each of which is formed by bending one plate material, a front plate 14 attached to an upper part between front ends of both the side plates 13, and a heat shield plate 15 that covers upper inner side surfaces of the rear plate 12 and both the side plates 13. An ignition plug 14*a* and a flame detecting element 14*b* such as a flame rod are attached to the front plate 14.

Figure 3:
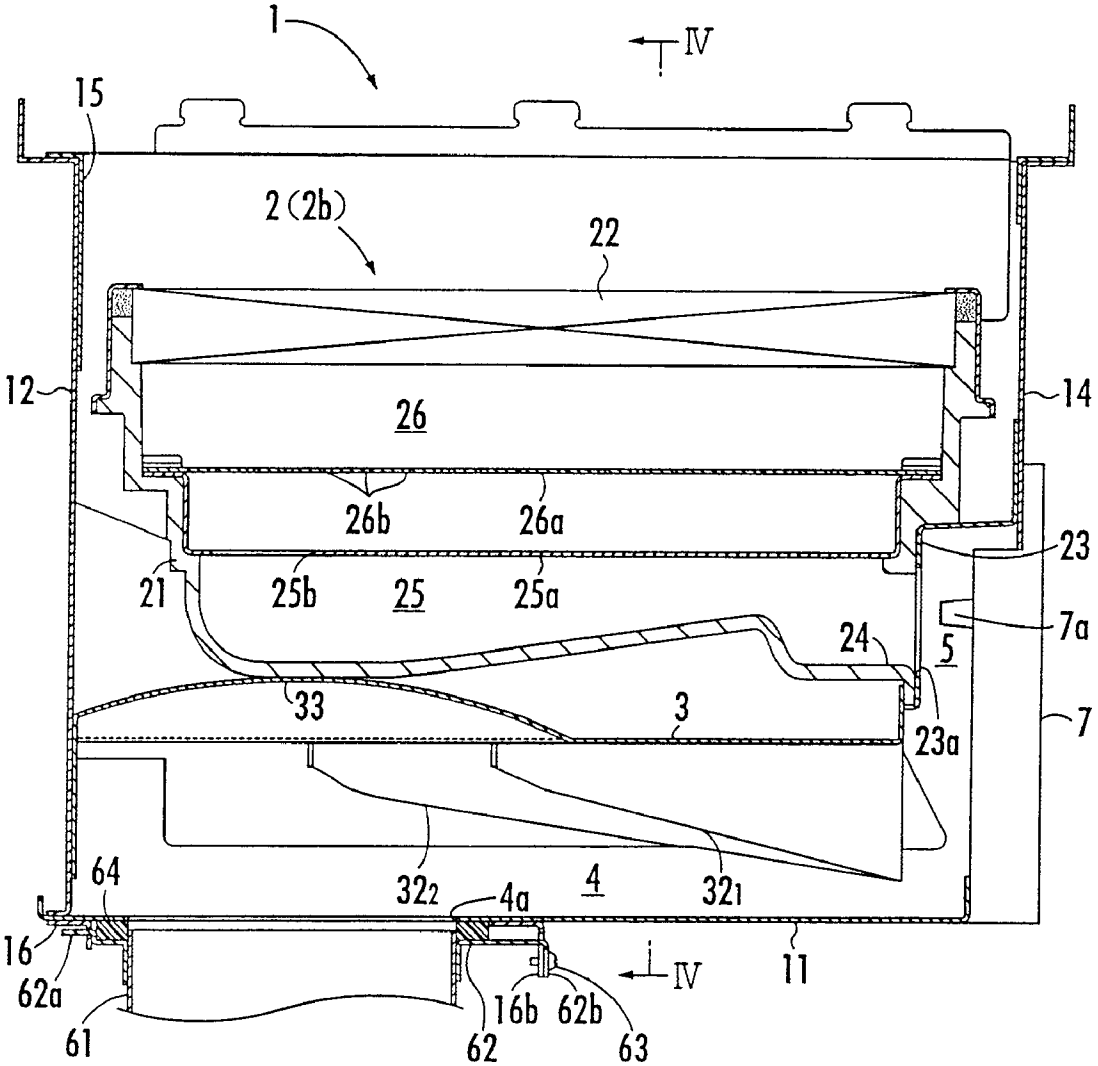
FIG. 3 is a sectional side view taken along line III-III in FIG. 1.

In the combustion housing 1, an air supply chamber 4 in a lower part partitioned by a partition plate 3 from an arrangement section of the burner unit 2 and a primary air chamber 5 that stands from a front end of the air supply chamber 4 as shown in FIG. 3 are provided. A combustion fan 6 is connected to an air supply port 4*a* opened in a bottom surface of the air supply chamber 4 formed by the bottom plate 11 of the combustion housing 1 such that the air from the combustion fan 6 is sent to the primary air chamber 5 through the air supply chamber 4. A large number of vent holes 31 are formed in a peripheral part of the partition plate 3. An air curtain flowing to further above than the burner unit 2 is generated along an inner side surface of the combustion housing 1 by the air that is jetted upward from the air supply chamber 4 through the vent holes 31. Consequently, a combustion exhaust gas does not come into contact with the inner side surface of the combustion housing 1. A heat loss and corrosion of the combustion housing 1 due to the combustion exhaust gas are prevented.

The structure for connecting the combustion fan 6 to the air supply port 4*a* will be explained with reference to FIGS. 2 and 3. A fan attaching frame 16 surrounding the air supply port 4*a* is fixed to a lower surface of the bottom plate 11 of the combustion housing 1. A slit 16*a* on a rear side and a pair of left and right fixing sections 16*b* on a front side are provided in the fan attaching frame 16. Screw holes 16*c* are formed in the respective fixing sections 16*b*. On the other hand, a flange plate 62 is externally fit and fixed in an air outlet 61 of the combustion fan 6. A tongue section 62*a* on the rear side and a pair of left and right ear sections 62*b* on the front side are provided in the flange plate 62. Attaching holes 62*c* are formed in the respective ear sections 62*b*. The respective ear sections 62*b* are overlapped with front surfaces of the respective fixing sections 16*b* with the tongue section 62*a* being inserted in the slit 16*a* and screws 63 are screwed in the screw holes 16*c* through the attaching holes 62*c*, whereby the combustion fan 6 is connected to the air supply port 4*a*. A washer 64 in contact with a lower surface at a peripheral edge of the air supply port 4*a* on an inner side of the fan attaching frame 16 is mounted on an upper surface of the flange plate 62.

Figure 4:
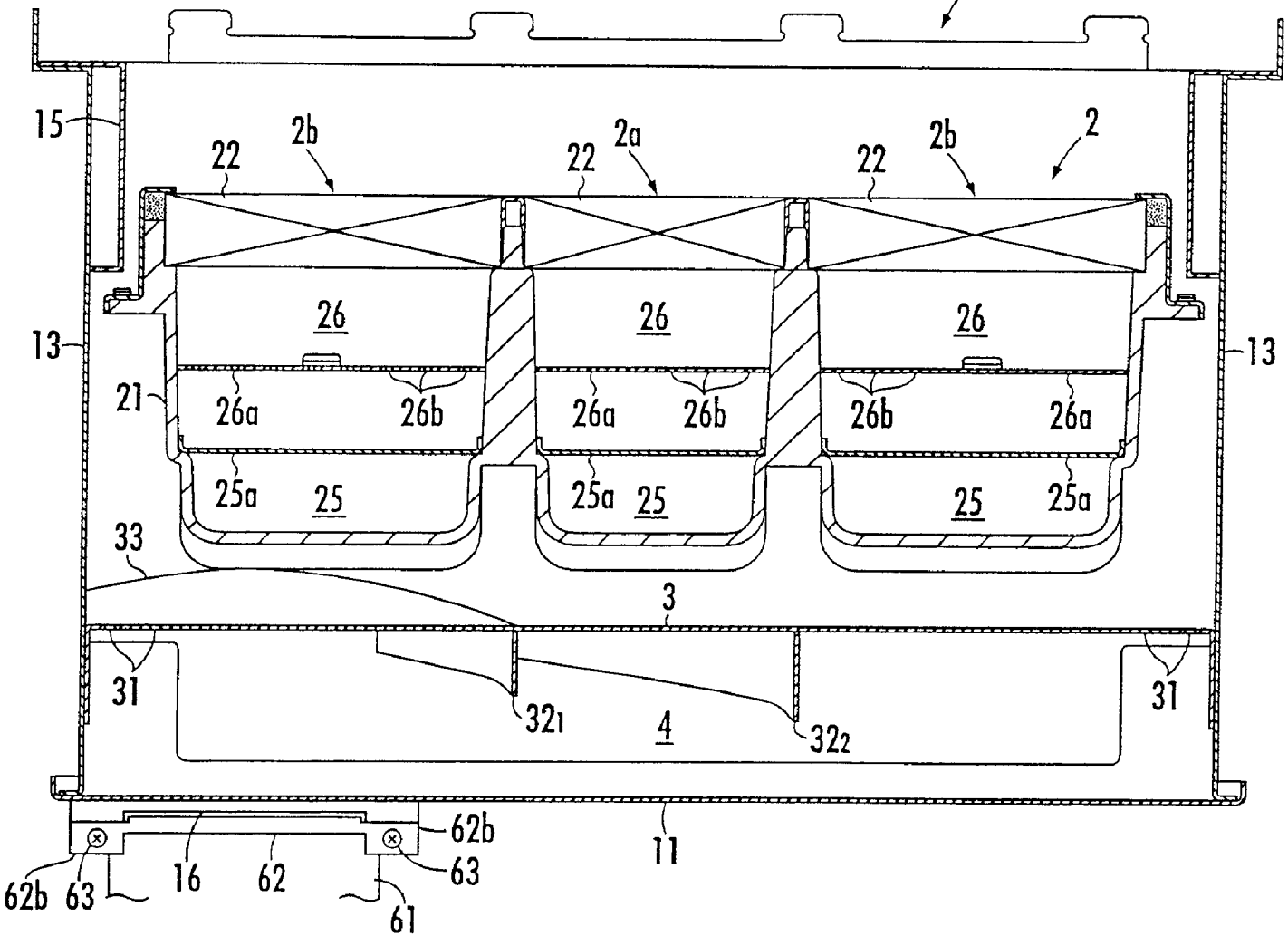
FIG. 4 is a sectional front view taken along line IV-IV in FIG. 3.

The burner unit 2 includes a small burner 2*a* in the center in the horizontal direction and a pair of large burners 2*b* on both sides in the horizontal direction. Each of the burners 2*a* and 2*b* includes, as shown in FIGS. 3 and 4, a plate type burner with a combustion plate 22 made of ceramic, which has a large number of flame holes, mounted on an upper surface of a burner main body 21 of a box shape. In a lower part of a front surface of the burner main body 21, an inflow port 24 that communicates with the primary air chamber 5 through a damper hole 23*a* formed in a damper 23 attached to the front surface of the burner main body 21 is opened. In the burner main body 21, a mixing chamber 25 in a lower part extending backward from the inflow port 24 and a distribution chamber 26 in an upper part that communicates with the mixing chamber 25 through an opening 25*b* formed in a rear part of an upper surface plate 25*a* of the mixing chamber 25 are provided. In the distribution chamber 26, a distribution plate 26*a* that sections the distribution chamber 26 into upper and lower two chambers is provided. A large number of distribution holes 26*b* are formed in the distribution plate 26*a* such that a pressure distribution in a portion of the distribution chamber 26 between the combustion plate 22 and the distribution plate 26*a* is uniformalized. The burner main body 21 of each of the burners 2*a* and 2*b* is integrated with the burner main body 21 of the burner adjacent thereto by a sidewall of the distribution chamber 26.

A front surface of the primary air chamber 5 is closed by a gas manifold 7. A gas nozzle 7*a* facing the inflow port 24 of each of the burners 2*a* and 2*b* is provided in the gas manifold 7. In this way, the primary air flows into the mixing chamber 25 of each of the burners 2*a* and 2*b* from the primary air chamber 5 together with a fuel gas from the gas nozzle 7*a*. The fuel gas and the primary air are mixed in the mixing chamber 25 and an air fuel mixture having a lower fuel density than a theoretical air fuel ratio is generated. This air fuel mixture is jetted from the flame holes of the combustion plate 22 through the distribution chamber 26 and subjected to totally primary combustion. The gas manifold 7 is not shown in FIGS. 1 and 2.

The air supply port 4*a* is opened in a position biased to the left side of the air supply chamber 4. In this state, a pressure distribution in the primary air chamber 5 becomes nonuniform and a supply quantity of the primary air to a part of the burners of the burner unit 2 becomes excessively larger or excessively small.

Figure 5:
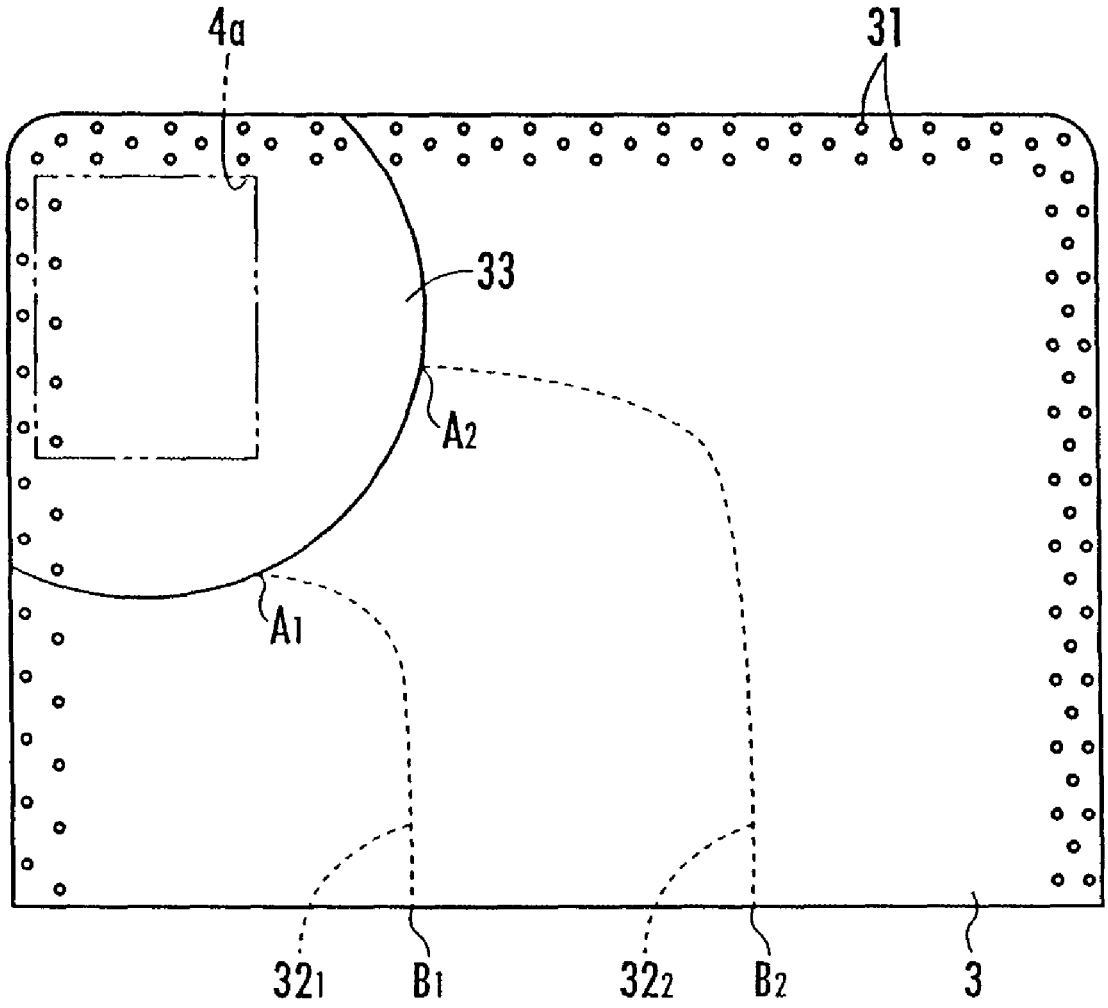
FIG. 5 is a plan view of a partition plate provided in the combustion apparatus according to the embodiment.

Thus, in this embodiment, first and second two projected rims $\mathbf{32}_1$ and $\mathbf{32}_2$ projected downward are arranged on a lower surface of the partition plate 3 in a layout shown in FIG. 5. A first upstream side section point $A_1$ closer to the left and a second upstream side section point $A_2$ closer to the inner right are set around the portion of the partition plate 3, which is opposed to the air supply port 4*a*, with a space formed between the section points in a peripheral direction of the portion of the partition plate 3. A first downstream side section point $B_1$ closer to the left located at a boundary between the small burner 2*a* and the large burner 2*b* on the left side and a second downstream side section point $B_2$ closer to the right located at a boundary between the small burner 2*a* and the large burner 2*b* on the right side are set at a front edge of the partition plate 3. The first projected rim $\mathbf{32}_1$ is set to connect the first upstream side section point $A_1$ and the first downstream side section point $B_1$ in a curve shape. The second projected rim $\mathbf{32}_2$ is set to connect the second upstream side section point $A_2$ and the second downstream side section point $B_2$ in a curve shape. The respective projected rims $\mathbf{32}_1$ and $\mathbf{32}_2$ are made of a plate material attached to the lower surface of the partition plate 3. However, it is also possible to form the respective projected rims $\mathbf{32}_1$ and $\mathbf{32}_2$ integrally with the partition plate 3 in draw forming of the partition plate 3.

If the projected rims $32_1$ and $32_2$ are provided in this way, the air supply chamber 4 is sectioned into three areas, i.e., a first area between a left side surface of the air supply chamber 4 and the first projected rim $32_1$, a second area between the first projected rim $32_1$, and the second projected rim $32_2$, and a third area between the second projected rim $32_2$ and a rear surface and a right side surface of the air supply chamber 4. The air from the combustion fan 6, which flows in from the air supply port 4*a*, is distributed and flows to these three areas. By appropriately setting positions of the respective upstream side section points $A_1$ and $A_2$ and the respective downstream side section points $B_1$ and $B_2$ and the shapes of layout lines of the respective projected rims $32_1$ and $32_2$ connecting the respective upstream side section points $A_1$ and $A_2$ and the respective downstream side section points $B_1$ and $B_2$, even if the air supply port 4*a* is opened in the position biased to the left, it is possible to uniformalize a pressure distribution in the primary air chamber 5 and supply the primary air to all the burners 2*a* and 2*b* of the burner unit 2 equally.

However, when the position and the angle of connection of the combustion fan 6 to the air supply port 4*a* fluctuate because of a positional deviation of the fan attaching frame 16 with respect to the bottom plate 11, clearance of the screws 63 with respect to the attaching holes 62*c* formed in the ear sections 62*b* of the flange plate 62, and the like, it is likely that the quantity of distribution of the air to the first to third areas of the air supply chamber 4 also fluctuates and a pressure distribution in the primary air chamber 5 becomes nonuniform.

Therefore, in this embodiment, the portion of the partition plate 3 opposed to the air supply port 4*a* is formed in a concave shape recessed upward as shown in FIGS. 3 and 4. Consequently, the air from the combustion fan 6, which flows in from the air supply port 4*a*, is once collected in the concave shape portion 33 of the partition plate 3 opposed to the air supply port 4*a*, a static pressure area having a uniform pressure distribution is generated, and the air is distributed from the static pressure area to the first to third areas of the air supply chamber 4. Even if the position and the angle of connection of the combustion fan 6 to the air supply port 4*a* fluctuate, since the air from the combustion fan 6 is collected in the concave shape portion 33 of the partition plate 3, the fluctuation in the position and the angle of connection of the combustion fan 6 is absorbed. Therefore, it is possible to effectively prevent a fluctuation from occurring in the quantity of distribution of the air to the first to third areas of the air supply chamber 4 because of the fluctuation in the position and the angle of connection of the combustion fan 6.

In this embodiment, the height of a downward projection of the respective projected rims $32_1$ and $32_2$ is reduced toward the respective upstream side section points $A_1$ and $A_2$. Consequently, the first to third areas of the air supply chamber 4 communicate with one another in a wide area in an upstream portion close to the air supply port 4*a*. Therefore, even if the fluctuation in the position and the angle of connection of the combustion fan 6 is not fully absorbed by the concave shape portion 33, a pressure in the upstream portion of the first to third areas is equalized by the mutual communication. It is possible to prevent the fluctuation from occurring in the quantity of distribution of the air to the first to third areas. In this way, a pressure distribution in the primary air chamber 5 is uniformalized regardless of the fluctuation in the position and the angle of connection of the combustion fan 6 and the primary air is supplied to all the burners 2*a* and 2*b* of the burner unit 2 equally.

It is desirable that the height of the downward projection of the respective projected rims $32_1$ and $32_2$ at the respective downstream side section points $B_1$ and $B_2$ is set to 70% to 100% of a height dimension of the air supply chamber 4 and the height of the downward projection of the respective projected rims $32_1$ and $32_2$ at the respective upstream side section points $A_1$ and $A_2$ is set to 0% to 30% of the height dimension of the air supply chamber 4.

The respective first and second downstream side section points $B_1$ and $B_2$ are offset to the right with respect to the respective first and second upstream side section points $A_1$ and $A_2$. Thus, in the second and third areas of the air supply chamber 4, the air once flows to the right from the air supply port 4*a*. Therefore, in this embodiment, a portion closer to the respective downstream side section points $B_1$ and $B_2$ of the respective first and second projected rims $32_1$ and $32_2$ connecting the respective first and second upstream side section points $A_1$ and $A_2$ and the respective downstream side section points $B_1$ and $B_2$ is extended in the front to back direction over a predetermined length. Consequently, a rectifying flow for directing an air flow to the front is obtained. It is possible to prevent the air having a motion component to the right from flowing into the primary air chamber 5.

The embodiment of the present invention has been explained with reference to the drawings. However, the present invention is not limited to the embodiment. For example, in the embodiment, the two projected rims $32_1$ and $32_2$ are provided on the lower surface of the partition plate 3. However, it is also possible to provide three or more projected rims. In the embodiment, the respective burners 2*a* and 2*b* of the burner unit 2 include the plate type burners of the totally primary combustion type. However, it is also possible to constitute the burner unit by providing a plurality of Bunsen burners, which are elongated in the front to back direction, side by side in the horizontal direction. In this case, a large number of distribution holes are formed in the partition plate 3 such that the air from the combustion fan 6 is supplied from the air supply chamber 4 to the respective burners through the primary air chamber 5 as the primary air and supplied to the arrangement section of the burner unit through the distribution holes as secondary air. In such a combustion apparatus, it is possible to supply the primary air to the respective burners equally by providing the projected rims $32_1$ and $32_2$ on the lower surface of the partition plate 3 as in the embodiment.

What is claimed is:

1. A forced air supply combustion apparatus, comprising:

a combustion housing, a burner unit including a plurality of burners provided side by side in a horizontal direction is arranged in the combustion housing, and an air supply chamber in a lower part partitioned by a partition plate from an arrangement section of the burner unit and a primary air chamber in a front part that stands from a front end of the air supply chamber, wherein air from a combustion fan connected to an air supply port opened on a bottom surface of the air supply chamber flows to the primary air chamber through the air supply chamber; and primary air is supplied from the primary air chamber to the respective burners of the burner unit, and wherein a plurality of projected rims projected downward are provided on a lower surface of the partition plate to connect a plurality of upstream side section points set around a portion of the partition plate, which is opposed to the air supply port, with a space formed between the section points in a peripheral direction of the portion of the partition plate and a plurality of downstream side section points set at a front edge of the partition plate with a space formed between the section points in the horizontal direction of the partition plate.

2. The forced air supply combustion apparatus according to claim 1, wherein the portion of the partition plate opposed to the air supply port is formed in a concave shape recessed upward.

3. The forced air supply combustion apparatus according to claim 2, wherein the height of a downward projection of the respective projected rims decreases toward the respective upstream side section points.

4. The forced air supply combustion apparatus according to claim 3, wherein the height of the downward projection of the respective projected rims at the respective downstream side section points is set to 70% to 100% of a height dimension of the air supply chamber and the height of the downward projection of the respective projected rims at the respective upstream side section points is set to 0% to 30% of the height dimension of the air supply chamber.

5. The forced air supply combustion apparatus according to claim 1, wherein the height of a downward projection of the respective projected rims decreases toward the respective upstream side section points.

6. The forced air supply combustion apparatus according to claim 5, wherein the height of a downward projection of the respective projected rims at the respective downstream side section points is set to 70% to 100% of a height dimension of the air supply chamber and the height of the downward projection of the respective projected rims at the respective upstream side section points is set to 0% to 30% of the height dimension of the air supply chamber.

7. The forced air supply combustion apparatus according to claim 1, wherein a portion closer to the respective downstream side section points of the respective projected rims connecting the respective upstream side section points and the respective downstream side section points, which are offset in the horizontal direction with respect to the respective upstream side section points, extends in a front to back direction over a predetermined length.

8. The forced air supply combustion apparatus according to claim 1, wherein the air supply chamber is defined by a bottom surface of the combustion housing, opposed side surfaces of the combustion housing, and the partition plate, and wherein the lower surface of the partition plate is directly opposed to and facing the bottom surface of the combustion housing.

9. The forced air supply combustion apparatus according to claim 8, wherein the portion of the partition plate opposed to the air supply port is formed in a concave shape recessed away from the bottom surface of the combustion housing.

10. The forced air supply combustion apparatus according to claim 1, wherein the plurality of projected rims separate the air supply chamber into a plurality of areas.

11. The forced air supply combustion apparatus according to claim 1, wherein the partition plate is provided substantially parallel with a bottom surface of the combustion housing, and the projected rims provided on the partition plate substantially orthogonally project from the lower surface of the partition plate toward the bottom surface of the combustion housing.

12. The forced air supply combustion apparatus according to claim 8, wherein a front edge of the partition plate is spaced from a front edge of the combustion housing.

* * * * *